United States Patent [19]

Bornstein

[11] Patent Number: 4,531,726

[45] Date of Patent: Jul. 30, 1985

[54] BOW SPRING DETECTOR FOR GRIPPER MECHANISM

[75] Inventor: Michael Bornstein, Claremont, Calif.

[73] Assignee: Metromail Corporation, Del.

[21] Appl. No.: 442,952

[22] Filed: Nov. 19, 1982

[51] Int. Cl.[3] ..... B65H 7/12

[52] U.S. Cl. ..... 271/263; 271/268

[58] Field of Search ..... 271/263, 262, 268, 277; 209/602, 603

[56] References Cited

U.S. PATENT DOCUMENTS

| | | | |
|---|---|---|---|
| 3,741,054 | 6/1973 | Alperin | 209/603 |
| 3,744,787 | 7/1973 | Morrison | 271/263 X |
| 3,885,780 | 5/1975 | Morrison | 271/263 X |

FOREIGN PATENT DOCUMENTS

| | | | |
|---|---|---|---|
| 896869 | 5/1962 | United Kingdom | 209/603 |

*Primary Examiner*—Richard A. Schacher

*Attorney, Agent, or Firm*—Harvey B. Jacobson

[57] ABSTRACT

The movable jaw on a gripper mechanism is engaged by a bowed spring feeler element to effect a change in its lateral deflection thereof at a maximum magnification ratio to displacement of the movable jaw from an operative position gripping a single sheet of paper. Deformation of the feeler element is regulated by a bearing abutment spaced from a contact sensing assembly through which the intermediate portion of the element extends to monitor the paper gripping operation.

13 Claims, 7 Drawing Figures

BOW SPRING DETECTOR FOR GRIPPER MECHANISM

BACKGROUND OF THE INVENTION

This invention relates generally to the monitoring of jaw movements on a gripper mechanism of a collator machine or the like, to detect the gripping of more than one or no sheet of paper during any single operational cycle.

Single sheet thickness detectors to monitor jaw movement in collating machines, are well known, such as those disclosed in U.S. Pat. Nos. 3,744,287 and 3,885,780. Such detectors include a mechanical linkage connection to the pivot shaft of a movable jaw carried by the gripper lever arm by means of which an electrical contactor is displaced relative to adjustably spaced contacts also carried on the gripper arm. The contacts are electrically connected to a malfunction indicator and/or a stop mechanism for interrupting operation of the associated collating machine in the event more than one or no sheet of paper is gripped between the jaws during an operational cycle of the gripper mechanism. Operation of the gripper mechanism is thereby limited to withdrawing a single sheet of paper at a time from a storage magazine for deposit onto a moving conveyor. The foregoing type of sheet thickness detection arrangement, mounted entirely on the oscillating gripper arm, requires modification of the movable jaw or its pivot mounting and is inherently difficult to assemble, adjust and maintain. Detection reliability is thereby adversely affected.

It is therefore an important object of the present invention to provide a thickness detection arrangement for mounting on an oscillating gripper arm that is simple to assemble and adjust. A further object is to provide for more sensitive and reliable detection of jaw movement on the gripper arm of a gripper mechanism in a collating machine.

SUMMARY OF THE INVENTION

In accordance with the present invention, an elastically deformable feeler element in the form of a leaf spring is anchored at one of its ends of the oscillating lever arm independently of the pivotal mounting of the movable jaw. The other end of the feeler element is loaded by contact with the movable jaw in its operative position gripping a single sheet of paper. In the jaw contacting condition, the feeler element is bowed or laterally deflected from its column axis. Such bowed condition of the feeler element is maintained in other positions of the movable jaw by an abutment bearing block engaging the feeler element adjacent to the jaw contacting end to produce maximum magnification of movable jaw displacement from the operative position at an intermediate location on the feeler element. An adjustable contact assembly is mounted on the lever arm at said intermediate location so as to sense such displacement of the movable jaw from the operative position. Thus, the intermediate portion of the feeler element extends between adjustably spaced contact elements of the contact assembly.

BRIEF DESCRIPTION OF THE DRAWINGS

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
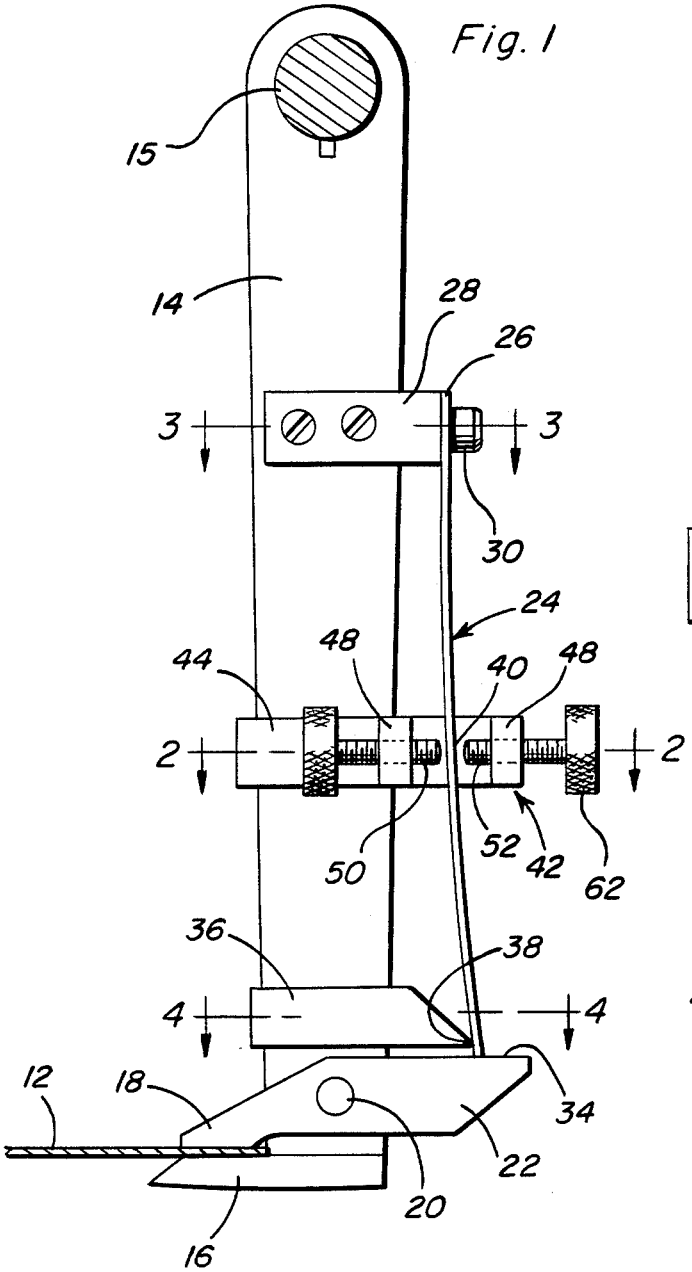
FIG. 1 is a side elevation view of a typical gripper mechanism on which the sheet thickness detection system of the present invention is installed.
Figure 5:
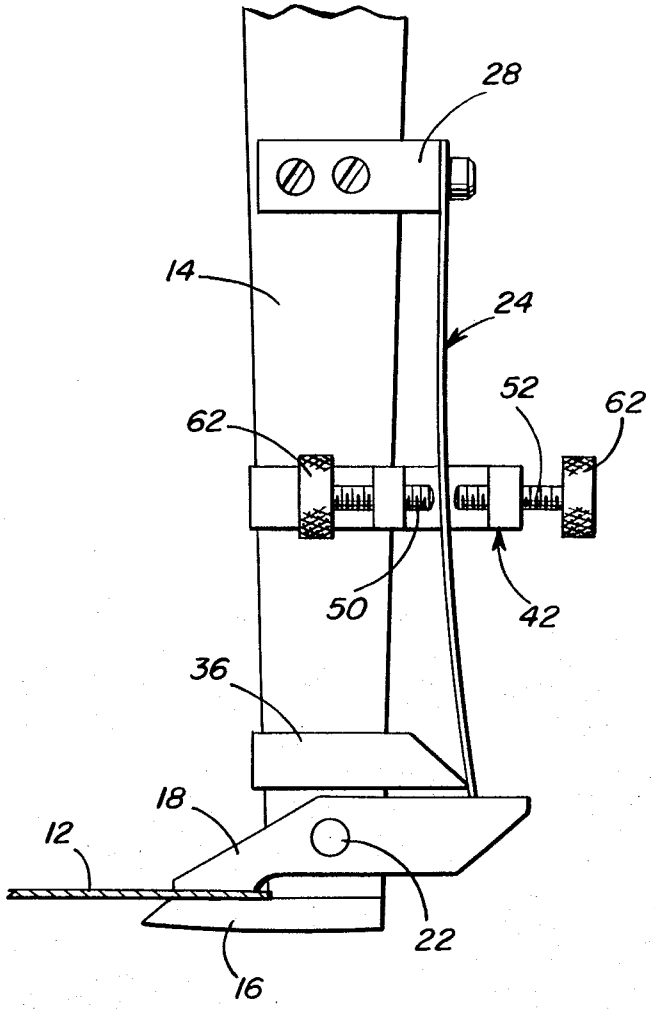

Referring now to the drawings in detail, FIG. 1 illustrates a typical gripper mechanism 10 associated with a continuous collating machine in which a sheet of paper 12 is withdrawn from a storage magazine and deposited onto a moving conveyor belt. Toward that end, a lever arm member 14 is cyclically oscillated by a power shaft 15 through a predetermined stroke, at one end of which the sheet 12 is gripped between a fixed jaw 16 secured to a lower end of lever arm 14 and a movable jaw 18 carried on the arm 14 by means of a pivot shaft 20. The jaws are opened and closed in proper phase relation to the cyclic movement of lever arm 14 in a manner well known in the art. The sheet 12 is gripped at one end of the stroke of the lever arm to withdraw the sheet from the magazine and dropped onto the moving conveyor as the lever arm approaches the other end of its stroke, by opening of the jaws. The movable jaw 18 has a trailing extension portion 22 as shown and is spaced from the fixed jaw 16 by an amount equal to the thickness of the single sheet of paper 12 during the gripping phase of operation as shown in FIGS. 1 and 5. A detector system is usually associated with such a gripper mechanism to monitor the spacing between the jaws during the gripping phase so as to interrupt operation of the collating machine if no sheet or more than one sheet is gripped between the jaws as respectively shown in FIGS. 6 and 7.

Figure 4:
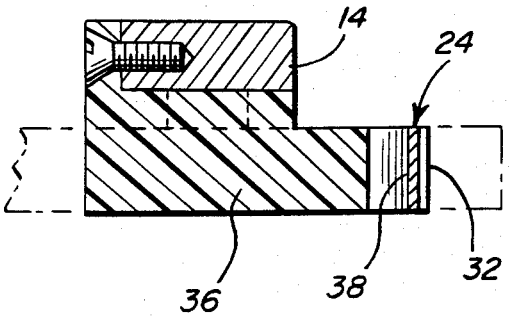

The detector system in accordance with the present invention features an elongated feeler element, generally referred to by reference numeral 24, in the form of an elastically deformable leaf spring having an upper end portion 26 anchored to the lever arm 14 by means of an anchor block 28 to which the element 24 is secured by fastener 30. The opposite lower end portion 32 of the feeler element is loaded by engagement with the top surface 34 on the extension 22 of the movable jaw 18. The location of the anchoring block 28 on the lever arm 14 relative to jaw pivot shaft 20 and the longitudinal dimension of the feeler element 24 are such that the feeler element is laterally deformed from alignment with its longitudinal column axis, or bowed, as shown in FIG. 1 under end loading applied by the movable jaw engaging the feeler element is in its operative gripping position. In such bowed condition of the feeler spring element, it is in lateral contact with an abutment rest block at a bearing edge 38 located adjacent the lower end portion 32 of the feeler element. The block 36 is accordingly secured to the lever arm 14 as more clearly seen in FIG. 4.

Figure 2:
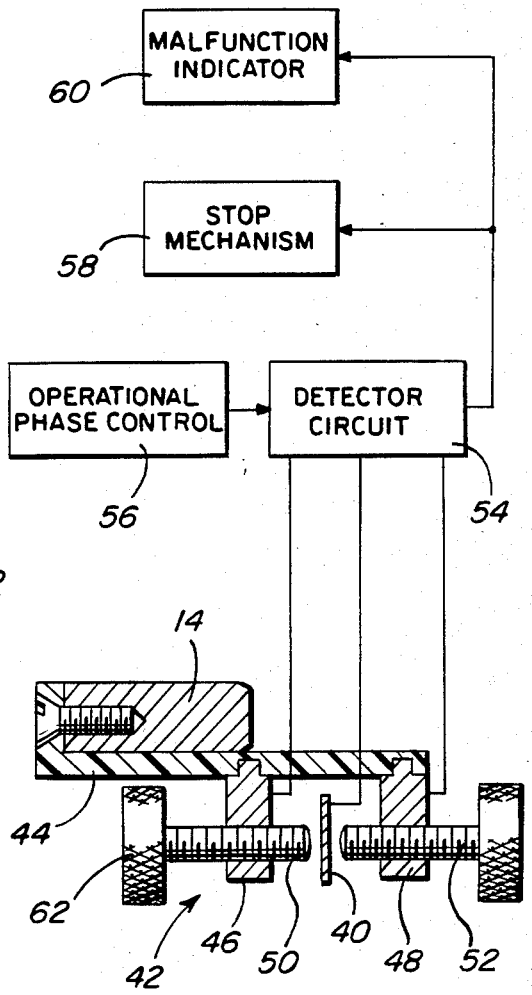
FIG. 2 is a transverse section view taken substantially through a plane indicated by section line 2—2 in FIG. 1, with associated controls shown by block diagram.
Figure 3:
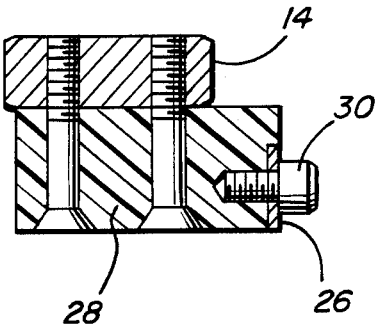
FIGS. 3 and 4 are transverse section views taken substantially through planes indicated by section lines 3—3 and 4—4 in FIG. 1.

It will be apparent that pivotal displacement of the movable jaw 18 from its operative gripping position as shown in FIGS. 1 and 5 will effect a change in the lateral flexure or deformation of the feeler element. The change in lateral deformation occurs at a maximum magnification ratio to jaw displacement along an intermediate portion 40 of the feeler element where it extends through an adjustable contact sensing assembly generally referred to by reference numeral 42 as shown in FIGS. 1 and 2. The contact assembly includes a mounting support 44 made of an electrically non-conductive material secured to the lever arm. A pair of spaced nut members 46 and 48 project from the support and threadedly mount spaced contact elements 50 and 52. Thus, the confronting ends of the contact elements 50 and 52 form a gap through which the feeler element extends, the feeler element being made of an electrically conductive material in order to complete a current conducting path through one of the contact elements. The blocks 28 and 36 are accordingly made of electrically non-conductive material.

In the operative position of the movable jaw, the bowed feeler element 24 at intermediate portion 40 is maintained out of contact with both contact elements 50 and 52 so that no current path is completed within detector circuit 54 enabled during the gripping phase of operation by control component 56 as shown in FIG. 2. If, on the other hand, contact is made during the gripping phase, a signal is generated by the detector circuit 54 to interrupt machine operation through stop mechanism 58 and turn on a malfunction indicator 60.

Figure 7:
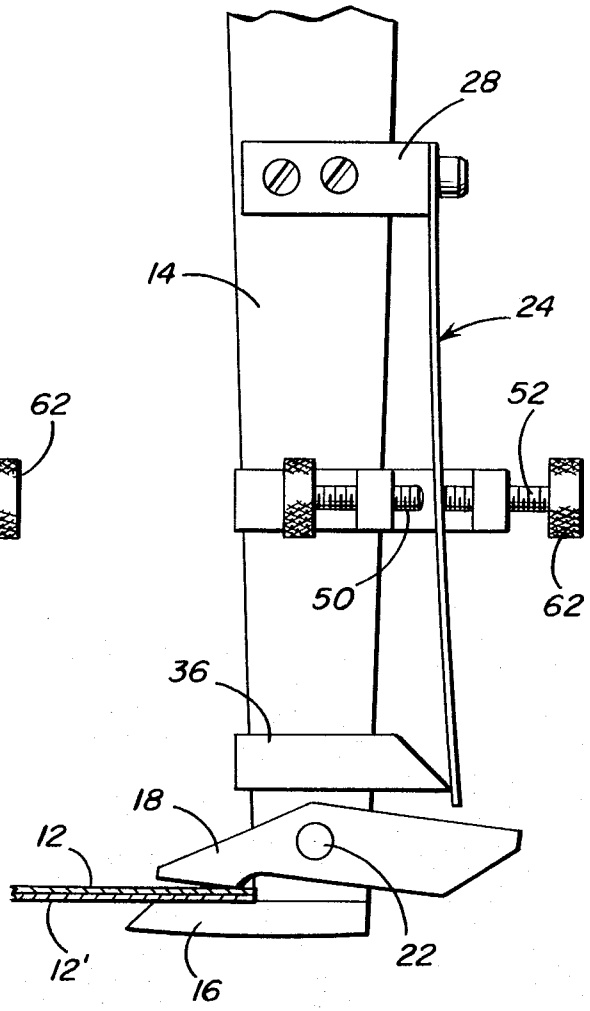
FIGS. 5, 6 and 7 are side elevation views of the gripper mechanism in the gripping phase under operative and malfunctioning conditions.
Figure 6:
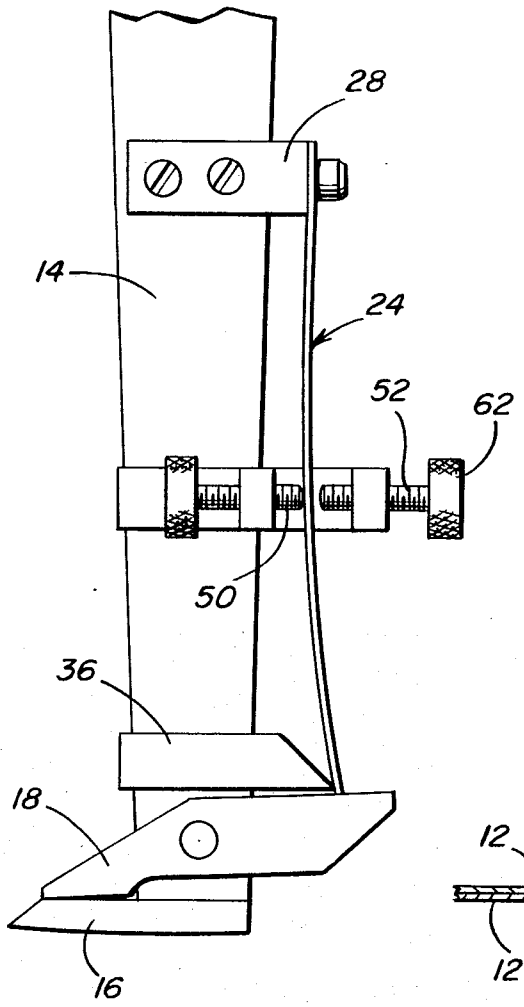

Contact is made between the feeler element and contact element 50 as shown in FIG. 6 when no sheet of paper is gripped between jaws 16 and 18. In this malfunctioning condition, the feeler element is bowed or laterally deformed to a greater extent in view of the constraint imposed by abutment bearing block 36. Contact is made between the contact element 52 and the feeler element as shown in FIG. 7 when the movable jaw grips two or more sheets of paper 12 and 12'. In the latter malfunctioning situation, the feeler element is maintained in a less bowed condition by the abutment block 36 even if the jaw no longer contacts the end portion 32 of the feeler elements. Thus, the abutment block 36 regulates and maintains lateral deformation of the feeler element to establish the contact relationships respectively shown in FIGS. 5, 6 and 7. Adjustment knobs 62 are connected to the contact elements for rotation thereof to adjust the gap spacing and location.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a gripper mechanism having a movable member, a fixed jaw secured to the member, a movable jaw mounted on the member and detector means for sensing displacement of the movable jaw relative to the fixed jaw, including a contact assembly mounted on the member having spaced contact elements and feeler means engageable with the movable jaw for contact with one of the contact elements in response to said displacement of the movable jaw from the operative position, the improvement residing in said feeler means comprising an elongated leaf spring element having opposite longitudinal ends, means anchoring the leaf spring element on the member for extension between the contact elements into contact with the movable jaw, and abutment means mounted on the member in engagement with the leaf spring element for holding the same in a bowed condition while out of contact with the movable jaw.

2. In combination with a gripper mechanism having a movable member, a fixed jaw secured to the member, a movable jaw mounted on the member and detector means for sensing displacement of the movable jaw relative to the fixed jaw, including an elongated, flexibly elastic feeler element having longitudinally opposite ends, anchoring means mounting the feeler element on the member for lateral deflection by contact of one of said ends by the movable jaw, abutment means mounted on the member and engageable with the feeler element for maintaining the lateral deflection thereof when said one of the ends is out of contact with the movable jaw, and sensing means mounted on the member for sensing changes in said lateral deflection of the feeler element in response to displacement of the movable jaw.

3. The combination of claim 2 wherein said sensing means includes spaced contact elements between which the feeler element extends at an intermediate location between the ends thereof.

4. In combination with a gripper mechanism having a movable member, a fixed jaw secured to the member, a movable jaw mounted on the member and detector means for sensing displacement of the movable jaw relative to the fixed jaw, including an elastically deformable feeler element engageable with the movable jaw, means for mounting the feeler element on the member in an elastically deformed condition when engaged by the movable jaw, means engageable with the feeler element for maintaining elastic deformation thereof when disengaged by the movable jaw, and contact means mounted on the member for sensing changes in the deformation of the feeler element.

5. The combination of claim 4 wherein said feeler element has opposite longitudinal end portions respectively anchored to the member by the mounting means and contacting the movable jaw when engaged thereby.

6. The combination of claim 5 wherein said feeler element has a laterally deflected portion intermediate said opposite longitudinal end portions.

7. In combination with a gripper mechanism having a fixed jaw, a movable jaw and detector means for sensing displacement of the movable jaw from an operative position relative to the fixed jaw, including an elongated, elastically deformable element having a longitudinal axis in an undeformed state thereof, means anchoring the element for deformation by end loading engagement with the movable jaw, and means for sensing changes in deformation of the element in response to displacement of the movable jaw from the operative position thereof.

8. The combination of claim 7 wherein said element has opposite longitudinal end portions respectively fixed by the anchoring means and contacting the movable jaw in the operative position, deformation of the element being in the form of deflection laterally of the longitudinal axis.

9. The combination of claim 8 wherein the changes in the deformation of the element is sensed by the sensing means at a location intermediate the opposite longitudinal end portions of the element.

10. The combination of claim 9 including abutment means in bearing contact with the element between the sensing means and one of the end portions of the element for maintaining deformation thereof.

11. In combination with a gripper mechanism having a cyclically movable member, a fixed jaw secured to the member, a movable jaw mounted on the member and detector means for sensing displacement of the movable member from an operative position relative to the fixed jaw, including elastically deformable feeler means mounted on the member independently of the movable jaw for contact therewith, bearing means carried by the member in engagement with the feeler means for maintaining the feeler means elastically deformed, and means mounted on the member for sensing changes in deformation of the feeler means in response to end loading by said contact with the movable jaw.

12. A detector for machines utilizing at least one gripper jaw assembly having a first jaw and a second jaw rotatably attached to one another and relatively rotatable to form a gap therebetween adapted to receive inserts, said detector comprising spaced apart electrodes mounted in fixed relation to the first jaw, a leaf spring having opposite longitudinal ends and an intermediate portion lying between said electrodes and normally occupying an intermediate position between said electrodes whereby relative rotation of the jaws causes said leaf spring to contact either of the electrodes depending on the number of inserts being gripped by the gripper jaw assembly and detector and indicator means electrically connected to said electrodes and to said leaf spring for sensing when one of said electrodes is in contact with said leaf spring, the improvement comprising means anchoring the leaf spring in fixed relation to the first jaw and in spaced relation to the electrodes for contact of the leaf spring at one of the ends with the second jaw, and abutment means engageable with the leaf spring for maintaining the leaf spring in a bowed condition when the second jaw is out of contact with the one of the ends of the leaf spring.

13. The combination of claim 12 wherein the gripper jaw assembly includes a movable member to which the first jaw is fixed in spaced relation to the anchoring means, the second jaw having a contact portion end loading the leaf spring at said one of the ends thereof.

* * * * *